United States Patent [19]

Nagati

[11] 4,128,232

[45] Dec. 5, 1978

[54] COOLING ASSEMBLY FOR METALLURGICAL VESSELS

[75] Inventor: Rashed N. Nagati, Mars, Pa.

[73] Assignee: Pennsylvania Engineering Corporation, Pittsburgh, Pa.

[21] Appl. No.: 811,571

[22] Filed: Jun. 30, 1977

[51] Int. Cl.[2] ..... C21C 5/42

[52] U.S. Cl. ..... 266/241

[58] Field of Search ..... 266/241, 243, 245, 246; 75/60

[56] References Cited

U.S. PATENT DOCUMENTS

| | | | |
|---|---|---|---|
| 3,679,195 | 7/1972 | Coulter et al. | 266/241 |
| 3,682,460 | 8/1972 | Pieper et al. | 266/241 |
| 3,963,223 | 6/1976 | Eysn | 266/241 |

*Primary Examiner*—Gerald A. Dost
*Attorney, Agent, or Firm*—Fred Wiviott

[57] ABSTRACT

An open topped, refractory lined metallurgical converter vessel has a metallic shell. A cooling jacket is affixed to the frusto-conical nose portion of the shell and comprises a plurality of right angle members affixed to the shell in a side-by-side relation and extending generally in the axial direction. The members have their edges respectively affixed to the shell surface and to the side of the next adjacent member such that one leg of each member is perpendicular and the other is parallel to the vessel surface. An opening is formed in the perpendicular leg of each angle member with the opening in adjacent members located at opposite ends to define a serpentine water flow path therethrough. Plate sections are affixed to the upper end of the angle members and to the shell to define a nose cooling ring and return flow path for cooling water. Further arcuate plate sections which at least partially surround the vessel at the lower ends of the angle members define water inlet and return flow paths.

11 Claims, 6 Drawing Figures

COOLING ASSEMBLY FOR METALLURGICAL VESSELS

BACKGROUND OF THE INVENTION

This invention relates to cooling assemblies for metallurgical converter vessels.

Pneumatic type metallurgical converters commonly include a generally pear-shaped vessel which is open at its upper end. Means are commonly provided for delivering oxygen to a molten charge contained within the vessel. The oxygen delivery system may include, for example, a lance which extends through the open mouth of the vessel or tuyeres which extend through the vessels bottom or sides. It is a common practice to cool the upper portion of such metallurgical vessels to minimize thermal deformation which would otherwise result from the high temperatures to which this portion of the vessel is exposed. Such cooling arrangements commonly take the form of pipes or hollow panels affixed to or adjacent the vessel surface. In addition, hollow means for receiving cooling fluid are often disposed in surrounding relation to the vessel mouth.

Water cooling of the areas of excessive elevated temperatures is desirable to stabilize external thermal distortion of the plates which define the outer metallic shell. Such distortion results from overheating of a particular area in relation to adjacent areas while the entire shell is subjected to mechanical stress from the molten metal within the furnace, the support loads and the external pressure due to thermal expansion of the lining refractory. Overheating can be caused by conductive heat transfer from the inside of the vessel and through the refractory, particularly when the refractory has been worn thin, intense radiant heat such as that experienced around the vessel tap nozzle, as well as external spills and slag spitting.

Where the cooling assembly is composed of pipe members, these generally include half pipes or angle members whose edges are affixed to the vessel surface. This provides an uneven surface which renders the removal of slag and metal relatively more difficult.

SUMMARY OF THE INVENTION

It is an object of the invention to provide a new and improved cooling assembly for metallurgical converter vessels.

A further object of the invention is to provide a cooling assembly which covers substantially the entire nose cone portion of a metallurgical vessel.

Another object of the invention is to provide a cooling assembly for metallurgical vessels which has a substantially smooth surface to facilitate the removal of solidified slag or metal.

Yet another object of the invention is to provide a water cooling assembly for metallurgical vessels wherein water velocity may be controlled for optimum heat transfer and irretardation of nucleate boiling.

A still further object of the invention is to provide a cooling assembly for metallurgical vessels wherein the necessity for connectors and fittings is minimized.

These and other objects and advantages of the present invention will become more apparent from the detailed description thereof taken with the accompanying drawings.

DETAILED DESCRIPTION OF THE PREFERRED EMBODIMENT

Figure 1:
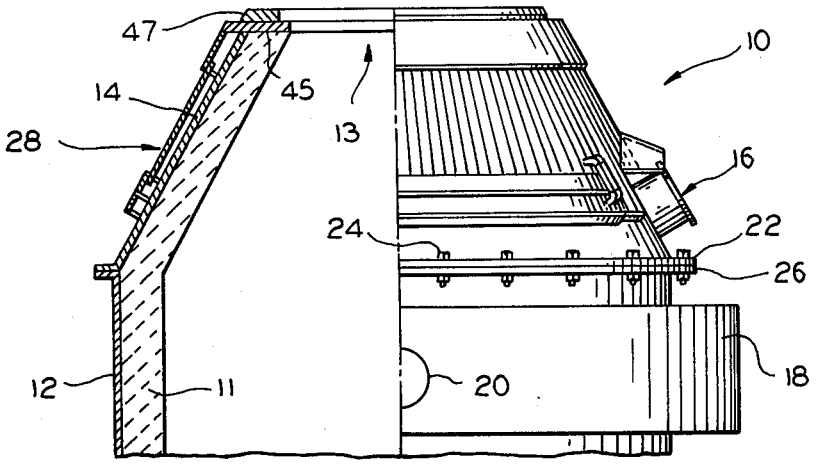
FIG. 1 is an elevational view of the upper portion of a metallurgical converter vessel incorporating the cooling assembly of the present invention.

FIG. 1 shows the upper portion of a metallurgical vessel 10 of the type wherein oxygen is injected into a molten metallic charge for the purpose of oxidizing undesirable constituents. While only a portion of the vessel is shown, it will be appreciated that it includes a refractory lining 11 and a metallic shell 12. In addition, the vessel is generally pear-shaped and has an opening 13 at its upper end for receiving a metallic charge. The upper section 14 of the shell 12 tapers upwardly and inwardly toward the opening 13 and is commonly referred to as a nose cone.

Vessels of the type illustrated in FIG. 1 are commonly mounted for pivatal movement about a horizontal axis so that they may be tilted for receiving a charge or for discharging metal through a tap nozzle 16. Toward this end, the vessel 10 may be mounted on a trunnion ring 18 which has a pair of trunnion pins 20 extending from its opposite sides. The vessel 10 may be affixed to trunnnion ring 18 by suitable brackets which are not shown but are well known in the art. The trunnion pins 20 may be supported by suitable bearings (not shown) and are coupled to a tilt mechanicsm (not shown).

The frusto-conical nose cone portion of the outer shell 14 is formed of steel plate and has a flange 22 at its lower end which permits attachment by means of bolts 24 to a mating flange 26 disposed at the upper end of the remaining portion of the furnace shell. A cooling assembly 28 according to the present invention is affixed to the nose cone shell portion 14.

Figure 4:
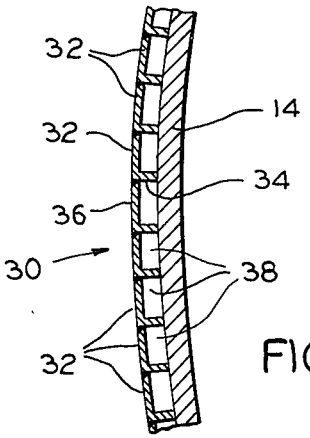
FIG. 4 is a view taken along lines 4—4 of FIG. 3.

The cooling assembly 28 comprises a jacket portion 30 which consists of individual cooling segments **30*a*, 30*b*, 30*c* and 30*d* each of which is defined by a central angle of 90°. Each segment includes a plurality of individual angle members 32 which are L-shaped in transverse cross-section and are affixed to the shell portion 14. As seen more particularly in FIG. 4, the edge of the short leg portions 34 of each angle member 32 is suitably affixed such as by welding to the metal shell portion 14 and each leg portion 34 extends in the radial direction relative to shell portion 14. The edge of the long leg portions 36 of each angle member 32 is welded to the outer side portion of the leg 34 of the next adjacent angle member 32. As a result, the legs 34 of angle members 32 are generally normal to the surface of shell portion 14 and the other legs 36 thereof are generally parallel to said surface. This defines a plurality of hollow water passages 38 extending generally in the axial direction along the outer surface of shell portion 14**.

Figure 6:
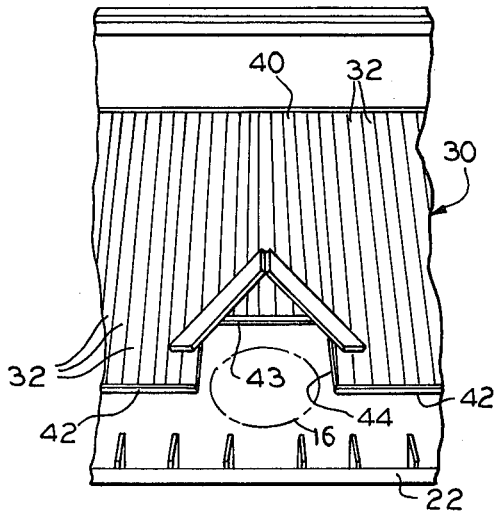
FIG. 6 is a view taken along lines 6—6 of FIG. 2.

Secured to the shell 14 adjacent the upper edges of each of the angle members 32 is an annular ring 40 which acts to close the upper end of substantially all of the passages 38. A similar ring 42 is affixed to the vessel and the members 32 adjacent the lower end of the assembly for enclosing substantially all of the lower ends of the passages 38 as will also be discussed below. It will be appreciated that the rings 40 and 42 may be a single member or a plurality of segments and may be affixed in any suitable manner such as by welding. Also, while ring 40 is continuous, there is a gap in the member 42 adjacent the tap nozzle 16 as seen in FIG. 6. Also, the members 32 above nozzle 16 are shorter and their ends are closed by member 43 and a portion of the side of one member 32 is closed by a strip 44.

Figure 3:
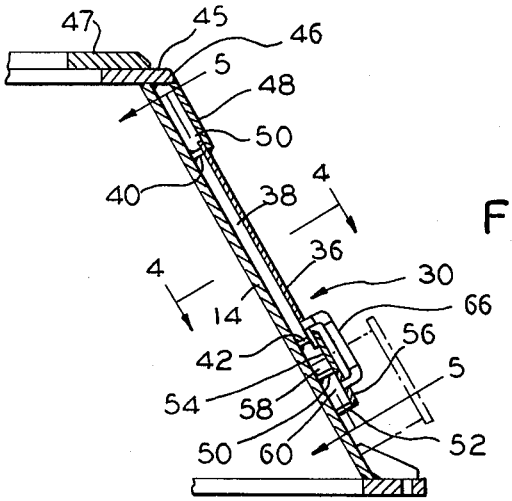
FIG. 3 is a view taken along lines 3—3 of FIG. 2.

Affixed to the upper end of the shell portion 14 and extending radially relative to the axis of the vessel is a nose ring 45. As seen in FIG. 3, the lower surface of the nose ring 45 is welded to the upper end of shell section 14 at a point displaced inwardly from its outer periphery. This defines a radially outwardly extending flange 46 which surrounds the upper end of shell portion 14. Also affixed to the upper surface of ring 45 is a second ring 47 having a smaller diameter.

An arcuate plate 48 which is a segment of a frustoconical section is secured above each cooling segment 30*a*, 30*b*, 30*c* and 30*d* to define a hollow passage 50 with the shell portion 14, the member 32 and the ring 40. More specifically, each member 48 is affixed at its upper end to the outer periphery of the nose ring 44 and at its lower end to the outer surfaces of the members 32 which define its associated cooling segment and at a point adjacent their upper edges. Thus, four passages 50 each intersecting a 90° central angle is defined by the outer surface of the shell portion 14, ring 40, members 32, the nose ring 44 and the plates 48.

A pair of substantially semi-circular members 50 and 52 are affixed to the surface of shell portion 14 and each is I-shaped in transverse cross-section. The members 50 and 52 are generally equidistantly spaced apart and are parallel relative to each other and to the ring portion 42. A first arcuate plate 54 which is substantially coextensive with the member 50 is secured to the cooling segments 30*a*–30*d* and to member 50 and is oriented in spaced apart parallel relation relative to the surface portion 14. Similar member 56 is secured between members 50 and 52 and is also disposed in spaced apart parallel relation relative to shell portion 14. This defines a pair of substantially semi-annular passages 58 and 60 disposed below and arranged generally normally to the passages 38 of segments 30*a*, 30*b*, 30*c* and 30*d*. The members 50 and 52 and the plates 54 and 56 span the cooling segments 30*c* and 30*d* and overlap the edges of the other segments 30*a* and 30*b*. Accordingly, the passages 58 and 60 are disposed adjacent at least some of the passages 38 of each cooling segment.

The cooling segments 30*a*, 30*b*, 30*c* and 30*d* are substantially identical except for their relationship to the inlet and outlet passages as will be discussed below and except for the shortened portion of segment 30*b*. Accordingly, only one segment 30*b* will be discussed in detail for the sake of brevity.

Figure 5:
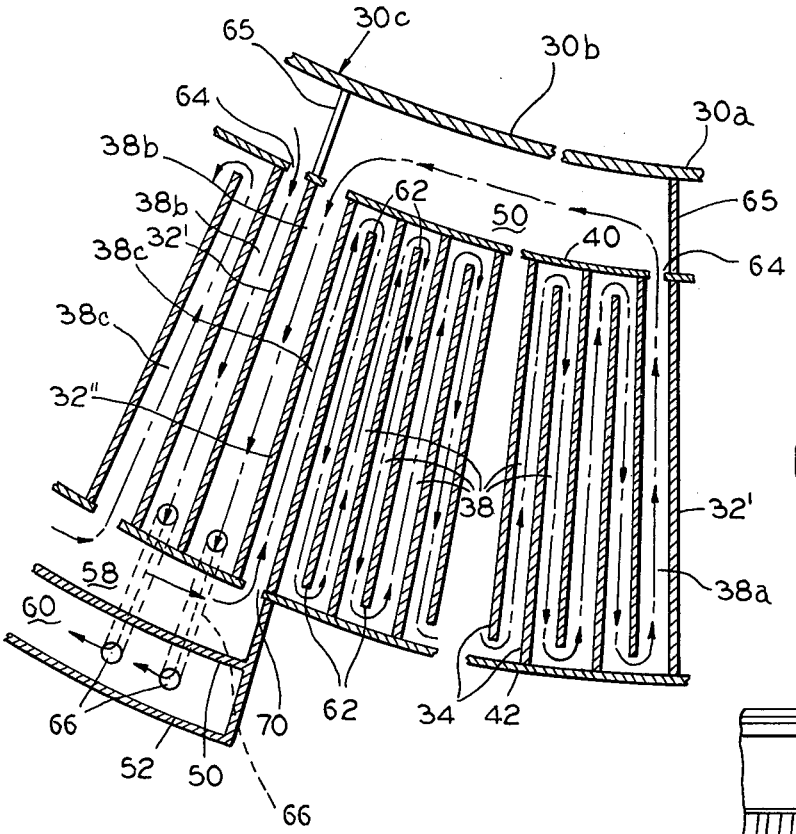
FIG. 5 is a view taken along lines 5—5 of FIG. 3.

As seen in FIG. 5, each of the angle members 32 of segment 30*b* except those at the ends of each cooling segment 30*a*–30*d* have a recessed portion 62 formed in one end of its respective leg 34 with the members 32 arranged such that the gaps 62 are at alternate ends of adjacent members 32. The members 32' which define the end of segment 30*b* are ungapped to prevent flow of cooling water between segments 30*b* and 30*a*. Similarly, the first member 32 of segment 30*c* is ungapped to prevent cross water at the junction of segments 30*b* and 30*c*. Also, the member 32" at the opposite end of segment 32*b* is imperforate to separate inflowing and outflowing water streams.

Member 40 has an opening 64 at each of the opposite ends of that portion within segment 30*b* and corresponding to the flow passages 38*a* and 38*b* at the ends of the segment. This provides communication between the passage 50 and the end passages 38*a* and 38*b*. Wall members 65 separate the passage 50 into segments corresponding to each of the cooling segments 30*a*, 30*b*, 30*c* and 30*d*. In addition, the lower end of one end passage 38*b* in each cooling segment is connected by a shunt pipe 66 to the passage 60. Member 42 also has an opening 70 formed therein at a point immediately below the passage 38*c* which is immediately adjacent the passage 38*b*. Further, a cooling water inlet pipe 72 (FIG. 2) is connected to member 54 at its approximate midpoint and a cooling water outlet pipe 74 is connected to the approximate midpoint of member 56.

Figure 2:
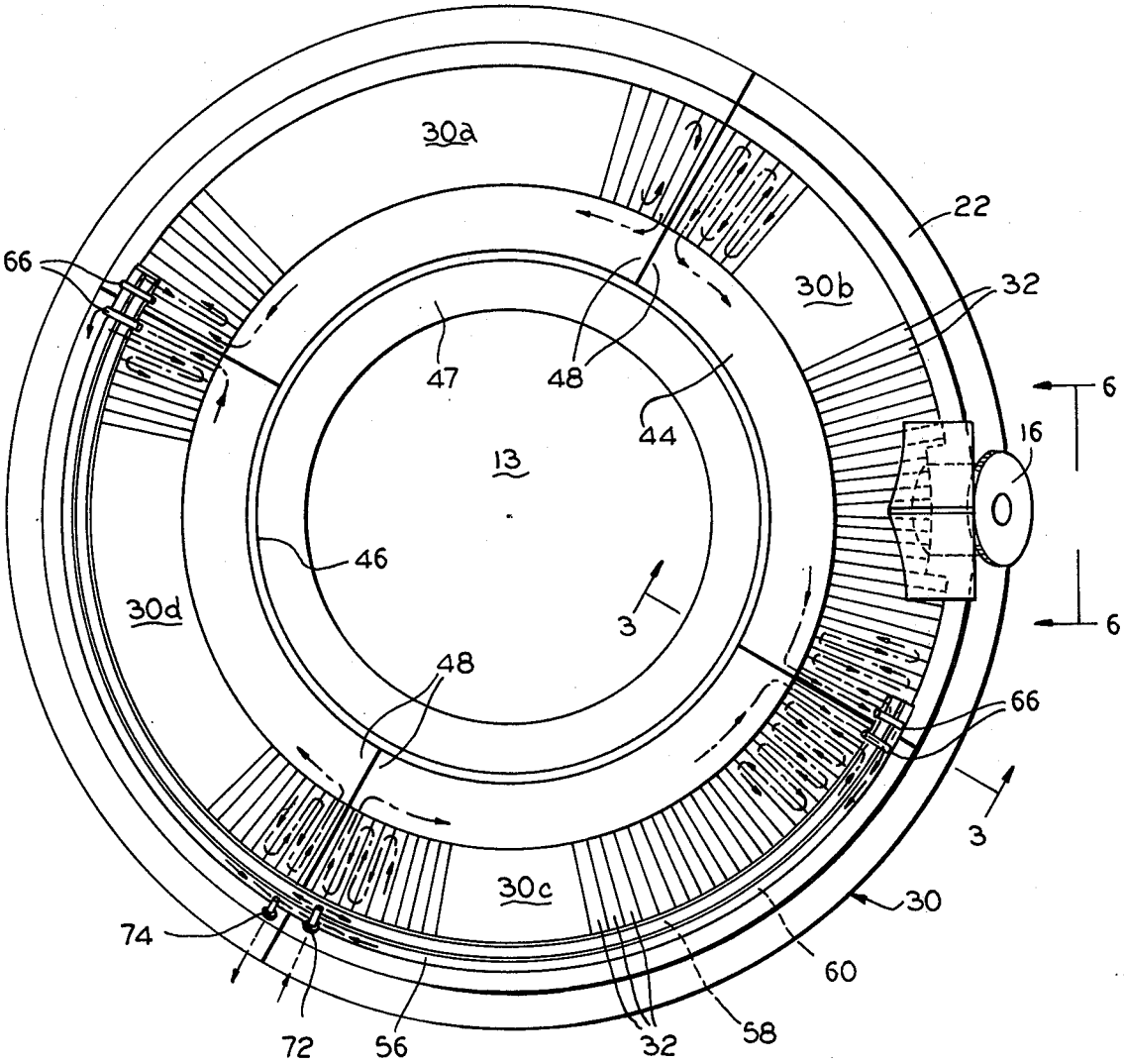
FIG. 2 is a top plan view of the vessel and cooling assembly shown in FIG. 1.

Referring now to FIGS. 2 and 5, it will be appreciated that when cooling water is delivered through inlet pipe 72 to the passage 58, it will flow into each of the segments 30*a*, 30*b*, 30*c* and 30*d* through the passages 38*c*. The cooling water will then traverse each of the passages 38 in each segment with the water in adjacent passages 38 flowing in opposite directions. Upon reaching the upper end of passage 38*a*, the water will exit through aperture 64, and then flow the entire length of the passage 50 after which it will flow downwardly through passage 38*b*, continue through shunt pipe 66 and into the passage 60 for flow to the outlet pipe 74.

It can be seen from the foregoing that the cooling water will be flowing in all parts of the cooling assembly for cooling substantially the entire nose cone section 14. In addition, because the flow passages through which the cooling water traverses are relatively narrow, a high cooling water velocity can be maintained. This provides the desired heat transfer and also retards nucleate boiling. The configuration also provides a smooth outer surface on the cooling assembly 28 which facilitates the removal of solidified slag or skull and minimizes the external pipe connections.

While only a single embodiment of the present invention has been illustrated and described, it is not intended to be limited thereby but only by the scope of the appended claims. For example, while the members 32 are shown to be generally L-shaped in cross-section, other shapes may also be employed so long as there are at least a pair of perpendicular portions.

I claim:

1. A metallurgical vessel having a top opening and cooling means disposed on the surface of said vessel and adjacent said top opening, a plurality of elongate members affixed to the surface of said vessel in a side-by-side relation and extending generally in the axial direction to define a plurality of adjacent flow passages, most of said flow passages being in communication adjacent one of their ends with the flow passage on one side thereof and being in communication with the flow passage on the other side thereof at a point adjacent their other end so that cooling liquid in adjacent passages flows in opposite directions, means defining an elongate flow passageway disposed adjacent one of the ends of said plurality of flow passages and being in communication with one end of first and second spaced apart ones of said plurality of flow passages, said flow passageway defining means at least partially surrounding said vessel top opening, the other end of one of said first and second flow passages being connected to a drain, one end of a flow passage adjacent one of said first and second flow passages being connected to an inlet, first and second closure means for closing the opposite ends of said members, said first closure means being disposed between said members and said elongate flow passageway, first and second spaced apart apertures formed in said first closure means and adjacent the ends of the first and second spaced apart ones of the plurality of flow passages, said second closure means having a third aperture therein for connecting the other end of said first flow passage to said inlet, a fourth aperture formed in one of said members disposed adjacent said first flow passage for connecting the passage defined by said one member to a cooling fluid outlet.

2. The apparatus set forth in claim 1 wherein said members each include a first leg affixed to said vessel and disposed generally perpendicularly to the surface thereof and a second leg disposed substantially at a right angle to said first leg and oriented generally parallel to the surface of said vessel, said second leg being affixed to the adjacent member whereby the passage is defined between said member, said adjacent member and the surface of said vessel.

3. The apparatus set forth in claim 2 wherein said vessel includes a nose ring disposed in surrounding relation to said vessel opening and having a peripheral margin which extends outwardly from the surface of said vessel, said flow passagway defining means including arcuate plate means affixed at one edge to the periphery of said nose ring and at its other edge to the surface defined by the second legs of said members.

4. The apparatus set forth in claim 3 wherein said vessel has a substantially frusto-conical upper end, said cooling means being frusto-conical and engaging frusto-conical portion of said vessel in surrounding relation and disposed below the vessel opening.

5. The apparatus set forth in claim 4 wherein spaced apart ones of said members have recesses formed in the first leg portions thereof for communication with adjacent passages, spaced apart ones of said members being imperforate to define isolated cooling segments spaced around said vessel, each of said cooling segments having passages at the opposite ends thereof communicating with the elongate flow passageway and one of said end passages communicating with said drain, another one of the passages of each segment communicating with said inlet.

6. The apparatus set forth in claim 5 and including first and second plate means affixed to said vessel surface in general parallelism with the surface defined by the second legs of said members, said plate means overlapping at least a portion of each of said cooling segments and defining the inlet and drain passages.

7. A metallurgical vessel having a generally frusto-conical upper end and a top opening and cooling means disposed on the surface of said vessel adjacent said opening, said cooling means including a plurality of elongate members affixed to the surface of the generally frusto-conical upper end of said vessel in a side-by-side relation and extending generally in the axial direction relative to said upper end to define a plurality of flow passages and being arrayed around the generally frusto-conical upper end of said vessel, said members each being generally L-shaped in transverse section and including a first leg affixed to said vessel and disposed generally perpendicularly to the surface thereof and a second leg disposed substantially at a right angle to said first leg and oriented generally parallel to the surface of said vessel, said second leg being affixed to the adjacent member whereby flow passages are defined between adjacent members and the surface of said vessel, said passages having one end proximate to said top opening and an opposite end remote therefrom, the second legs of said members defining a generally frusto-conical surface on said cooling means which is substantially continuous and parallel to the surface of said vessel, an opening formed in the first legs of a plurality of said members so that the flow passages defined by said members are interconnected, first and second elongate means disposed respectively adjacent the one and opposite ends of said flow passages for defining elongate flow passageways generally normal to said flow passages, closure means disposed at the opposite ends of said members for closing the same, said closure means having openings adjacent the ends of certain ones of said flow passages for connecting the same to said flow passageways, said first elongate means being generally annular and surrounding the open top of said vessel to provide a cooling ring therefor, one of said flow passageways being connected to a drain and the other to an inlet.

8. The apparatus set forth in claim 7 wherein an opening is provided in the first leg of at least a plurality of each of said members with the opening disposed at the opposite ends of adjacent members whereby cooling fluid will pass between adjacent members at the ends thereof and wherein said cooling fluid will flow in opposite directions and adjacent members.

9. The apparatus defined in claim 8 wherein said elongate means is in communication with one end of a first and second spaced apart ones of said plurality of flow passages, the other end of one of said first and second flow passages being connected to a drain.

10. The apparatus set forth in claim 7 wherein said vessel includes a nose ring disposed in surrounding relation to said vessel opening and having a peripheral margin which extends outwardly from the surface of said vessel, said one elongate means including arcuate plate means affixed at one end to the projecting periphery of said nose ring and at its other edge to the surface defined by the second legs of said members to define the flow passageway means in surrounding relation to said vessel opening, at least some of said passages being connected to said flow passageway means.

11. A metallurgical vessel having an upper end which defines a generally frusto-conical section and a top opening, cooling means disposed on the surface of said vessel adjacent to and disposed in a generally surrounding relation to said opening, said cooling means including a plurality of elongate members which are generally L-shaped in transverse section, said members being affixed to the surface of said vessel in a side-by-side relation and extending generally in the axial direction relative to said section and having one end remote from said opening and another end proximate thereto to define a plurality of flow passages, said members each including a first leg affixed to said vessel and extending generally outwardly relative to the surface thereof and a second leg integral with said first leg and oriented generally parallel to the surface of said vessel, said second leg being affixed to the adjacent member whereby passages are defined between adjacent members and the surface of said vessel, the second legs of said members being configured such that all of said legs when in abutment provide a generally continuous frusto-conical surface substantially parallel to the surface of said section, the first legs of at least a plurality of said members having openings formed therein for interconnecting the passages formed thereby, an inlet connected to the remote end of one of said passages and an outlet connected to the proximate end of another one of said passages to insure that said passages are filled.

* * * * *